US005480752A

United States Patent [19]

Nishikiori et al.

[11] Patent Number: 5,480,752

[45] Date of Patent: Jan. 2, 1996

[54] ELECTROPHOTOGRAPHIC LITHOGRAPH PRINTING PLATE MATERIAL

[75] Inventors: Yoshiharu Nishikiori, Tokyo; Masahiro Yamana, Hasuda; Shiro Nakano, Yokohama, all of Japan

[73] Assignee: New Oji Paper Co., Ltd., Tokyo, Japan

[21] Appl. No.: 309,674

[22] Filed: Sep. 21, 1994

[30] Foreign Application Priority Data

Feb. 23, 1994 [JP] Japan ..... 6-047944

[51] Int. Cl.[6] ..... G03G 13/32

[52] U.S. Cl. ..... 430/49; 430/56; 430/63

[58] Field of Search ..... 430/49, 56, 63

[56] References Cited

U.S. PATENT DOCUMENTS 5,079,116 1/1992 Tachikawa ..... 430/49

5,368,931 11/1994 Kato ..... 430/49

FOREIGN PATENT DOCUMENTS 56-24361 3/1981 Japan .

58-124695 7/1983 Japan .

*Primary Examiner*—Kathleen Duda

*Attorney, Agent, or Firm*—Armstrong, Westerman, Hattori, McLeland & Naughton

[57] ABSTRACT

An electrophotographic lithograph printing plate material having excellent anti-toner fogging property and dimensional stability has an intermediate layer formed between a front surface of a substrate and a photoconductive layer and including a mixture of a polymeric binder, a specific dispersing agent comprising a member selected from a polyisoprenesulfonic acid and carboxylic acid-modified polyisoprenesulfonic acids, and pigment particles and electroconductive whiskers uniformly dispersed in the binder by the aid of the specific dispersing agent.

16 Claims, No Drawings

ELECTROPHOTOGRAPHIC LITHOGRAPH PRINTING PLATE MATERIAL

BACKGROUND OF THE INVENTION

1. Field of the Invention

The present invention relates to an electrophotographic lithograph printing plate material. More particularly, the present invention relates to an electrophotographic lithograph printing plate material capable of forming thereon electrophotographic images resistive to fogging with toner and having a high dimensional stability and an excellent printing durability.

2. Description of the Related Art

Due to recent progress and development of small-size printing machines and automatic printing mechanisms, the emphasis on light printing process is now shifting to the offset printing process.

There has been much research and development going on regarding plate materials for the offset printing process, and as a result, various improved printing plate materials are now being practically used.

Among the conventional offset printing plate materials, an electrophotographic lithograph printing plate material having a photosensitive electrophotographic layer in which electroconductive zinc oxide particles are dispersed as a principal photoconductive material in a binder matrix, is most widely utilized in the light printing industry, because it is cheap and because the process for making the printing plate from the printing plate material is simple and easy.

In a conventional process for producing an electrophotographic lithograph printing plate, the printing plate material is subjected to a corona charging step, an image-forming light-exposing step, a developing step and a fixing step by using a printing plate-making machine to form visible images in the desired pattern on the photoconductive layer.

The developing step can be effected by either a dry developing method in which a mixture of a toner and a carrier consisting of an iron powder is used as a dry developing agent, or a wet developing method in which a developing liquid containing a toner dispersed in an organic solvent, for example, a petroleum solvent, with a high boiling temperature, is used.

The wet developing method for the preparation of the lithograph printing plate is advantageous in that the reproducibility of half-tone images is high, the resolving power is excellent, the plate-making time is short, and no correction is necessary for the formed images. Therefore, the wet developing method is widely utilized for the production of electrophotographic lithograph printing plates.

Due to the recent significant spread of computer systems in the printing industry, the printing plate-making process is now shifting from the above-mentioned analog process to a digital process. Namely, recent electrophotographic lithograph printing plate materials have a photoconductive layer containing a laser sensitizing agent consisting of a cyanine dye capable of sensitizing the photoconductive layer at a wavelength of about 780 nm. For this type of electrophotographic lithograph printing plate material, a computer-to-plate type printing plate-making method is advantageously utilized. In this method, the data in the computer is directly applied to the electrophotographic material by using a semiconductor laser light.

Generally, the electrophotographic lithograph printing material is required to satisfy various properties including image properties, which are common requirements for all the electrophotographic materials, for example, high image color density, anti-fogging property, sharpness, uniformity and resistance to stain on non-imaged portions; and printing plate properties, which are commonly required for all lithograph printing plates, for example, a property that after a developing step is applied, non-imaged portions of the developed lithograph plate can be desensitized to printing ink, a property that the non-imaged portions of the developed printing plate can be made hydrophilic, and a property that the developed printing plate exhibits a high water resistance to a large amount of wetting water applied to the printing plate surface during printing.

To enhance the toner-fogging resistance of images and the water resistance, an attempt has been made to arrange an intermediate layer between a substrate and a photoconductive layer.

For example, Japanese Unexamined Patent Publication (Kokai) No. 58-124,695 discloses an intermediate layer in which the water resistance thereof is enhanced by using an emulsion resin as a binder resin, and the anti-fogging property thereof is enhanced by adding carbon black thereto. However, the carbon black, which is hydrophobic, needs to be dispersed by using a large amount of a surface active agent which absorbs a large amount of water during the developing step, and thus the resultant printing plate has a low water-resistance and exhibits a poor dimensional stability.

Also, Japanese Unexamined Patent Publication (Kokai) No. 56-24,361 discloses an intermediate layer containing electroconductive zinc oxide which is used to enhance the anti-fogging property. In this attempt, to form images free from toner-fogging, the electroconductive zinc oxide must be contained in a large amount in the intermediate layer so as to cause the particles of the electroconductive zinc oxide to come into contact with each other. Therefore, the resultant intermediate layer becomes porous and exhibits a reduced water resistance. Thus, the resultant printing plate material exhibits an unsatisfactory dimensional stability.

SUMMARY OF THE INVENTION

An object of the present invention is to provide an electrophotographic lithograph printing plate material having a high resistance to toner-fogging.

Another object of the present invention is to provide an electrophotographic lithograph printing plate material having a high dimensional stability and a satisfactory printing durability.

The inventors of the present invention conducted extensive research to attain the above-mentioned objects, and as a result, it was discovered that the above-mentioned resistance to toner-fogging and dimensional stability of the electrophotographic lithograph printing plate material could be significantly enhanced by arranging an intermediate layer containing uniformly dispersed electroconductive whiskers between a substrate and a photoconductive layer. The present invention was completed based on this discovery.

Namely, the above-mentioned objects can be attained by the electrophotographic lithograph printing plate material of the present invention which comprises a substrate;

an intermediate layer formed on a front surface of the substrate and comprising a mixture of a binder comprising a polymeric material, a dispersing agent comprising at least one member selected from the group consisting of polyisoprenesulfonic acid and carboxylic acid-modified polyisoprenesulfonic acids, and pigment particles and electroconductive whiskers uniformly dispersed in the binder; and a photoconductive layer formed on a surface of the intermediate layer and comprising a mixture of an electrically insulating binder and photoconductive pigment uniformly dispersed in the binder.

DESCRIPTION OF THE PREFERRED EMBODIMENTS

The electrophotoconductive lithograph printing plate material comprises a substrate, an intermediate layer located on a front surface of the substrate and a photoconductive layer located on the intermediate layer.

The substrate usable for the electrophotographic lithograph printing plate material of the present invention comprises a member selected from the group consisting of paper sheets, laminated paper sheets with a metal foil, for example, aluminum foil, or a plastic film, for example, polyethylene film, and synthetic papers, for example, drawn plastic film comprising, as principal components, a thermoplastic resin, for example, polyolefin resin and an inorganic resin and having a void structure. Generally, the substrate preferably has a thickness of 100 to 168 μm.

The intermediate layer of the present invention is formed by preparing an aqueous coating liquid comprising a binder which is in the form of an aqueous solution or emulsion, a specific dispersing agent and pigment particles and electroconductive whiskers uniformly dispersed in the coating liquid, coating the aqueous coating liquid on the front surface of the substrate and drying the coated liquid on the substrate front surface.

In the present invention, the electroconductive whiskers can be uniformly dispersed together with the pigment particles in the aqueous coating liquid containing the aqueous solution or emulsion of the binder by the aid of the specific dispersing agent. Therefore, in the resultant intermediate layer on the substrate front surface, the electroconductive whiskers are evenly dispersed together with the pigment particles in a matrix consisting essentially of the binder resin.

If the intermediate layer is formed from only the conventional binder resin and pigment particles, without employing the electroconductive whiskers, it is possible to enhance the water-resistance and the dimensional stability of the resultant intermediate layer. However, this resultant intermediate layer exhibits a high electric resistivity and causes excessive photo decay of the electrostatic images formed on the photoconductive layer, and therefore, the resistance of the images to toner-fogging becomes unsatisfactory and the resultant images are not clear. To obtain clear images on the photoconductive layer, it is appropriate to adjust the surface resistivity of the intermediate layer to a level of from $10\times10^7$ Ω/□ to 10×10"Ω/□. The electroconductive whiskers are contributory to controlling the surface resistivity of the intermediate layer to the above-mentioned level, without reducing the water resistance of the intermediate layer.

Recently, various electroconductive whiskers have become producible from various ceramics and/or metal oxides at a low cost, and can be used for various purposes, for example, to form coating films or shaped articles, or to enhance an electroconductivity or dimensional stability of the films or articles. Usually, the electroconductive whiskers are mixed into a coating liquid containing an organic solvent or into a plastic resin compounds or kneaded together with a plastic resin material.

If it becomes possible to uniformly disperse the electroconductive whiskers in an aqueous liquid, the use of the electroconductive whiskers can be expanded. However, before the present invention, it was believed that uniformly dispersing the electroconductive whiskers in water was impossible. Namely, upon attempting to disperse the electroconductive whiskers in water by using a conventional dispersing agent, for example, a polyacrylic resins, usually this attempt was not successful. Even if the attempt appeared to be successful, the whiskers easily precipitate within a short time, and the settled whiskers become fixed to each other to form a hard stratum, so they no longer can be re-dispersed in water only by agitation.

Also, if the above-mentioned unstable aqueous dispersion of the electroconductive whiskers prepared by using the conventional dispersing agent, for example, the polyacrylic acid, is used to form an intermediate layer, the resultant intermediate layer contains the electroconductive whiskers unevenly distributed therein and thus the resultant printing plate material exhibits a poor resistance to toner-fogging.

In the present invention, the above-mentioned problems can be completely removed by using the specific dispersing agent preferably in an amount of 0.05 to 3% by weight, based on the weight of the electroconductive whiskers. The dispersing agent of the present invention comprises at least one member selected from polyisoprenesulfonic acid and carboxylic acid-modified polyisoprenesulfonic acids.

The polyisoprenesulfonic acid is a polymer produced by polymerizing isoprenesulfonic acid and is available usually in the form of a neutralized aqueous solution of a sodium or ammonium salt thereof. The polyisoprenesulfonic acid may be modified with a carboxylic acid to such an extent that 20% or less of the sulfonate groups are replaced by carboxylate groups. The polyisoprenesulfonic acid free from the carboxylate group is available, for example, under the trademark of DINAFLOW Z105, from Nihon Synthetic Rubber Co, and the carboxylic acid-modified polyisoprenesulfonic acid is available, for example, under the trademark of DINAFLOW P103, from Nihon Synthetic Rubber Co.

The dispersing agent is employed in an amount sufficient to fully disperse the electroconductive whiskers in the aqueous coating liquid for the intermediate layer, which amount is variable depending on the type and amount of the whiskers and other components in the intermediate layer. Preferably, the dispersing agent is used in an amount of 0.05 to 3.0% by weight, based on the weight of the electroconductive whiskers. If the amount is less than 0.05% by weight, sometimes the whiskers cannot be uniformly and stably dispersed in the coating liquid. Also, even if the amount is increased to a level of more than 3% by weight, the dispersing effect on the electroconductive whiskers is saturated, and sometimes the resultant intermediate layer exhibits a reduced water resistance. Accordingly, the use of the dispersing agent in an excessive amount is meaningless.

To disperse the electroconductive whiskers, a desired amount of the dispersing agent is dissolved in a necessary amount of water, the electroconductive whiskers are dispersed in the aqueous dispersing agent solution while agitating, and then the resultant dispersion is further agitated by using an agitator having a relatively high rotational speed, for example, a Kaures agitator to fully disperse the electroconductive whiskers in the aqueous dispersing agent solution. Then, the aqueous dispersion of the electroconductive whiskers is mixed with an aqueous binder resin solution or emulsion and an aqueous pigment dispersion to provide an aqueous coating liquid for the intermediate layer.

When the aqueous coating liquid is applied to both the front and back surfaces of a substrate, for example, a paper sheet, the resultant laminate is useful as a support for a lithograph printing plate material, because in an electrophotographic master sheet, namely an offset master, the support is required to have a certain degree of electroconductivity to enhance the discharge property of non-imaged portions of the master sheet during a printing plate-making step utilizing a photoconductivity thereof.

The electroconductive whiskers usable for the present invention comprise fiber-shaped whisker cores consisting essentially of a member selected from the group consisting of potassium titanate, aluminum borate, zinc oxide, titanium dioxide, aluminum nitride, boron nitride, titanium nitride, alumina, magnesium hydrogen sulfate and barium sulfate, and coating layers formed on the surfaces of the fiber-shaped whisker cores and consisting essentially of an electroconductive material comprising at least one member selected from the group consisting of electroconductive metals, for example, silver and copper, electroconductive metal oxides, for example, tin oxides and indium oxides, carbon.

The whisker cores have a length of 10 to 30 μm and a diameter of 0.2 to 1.2 μm, and the electroconductive coating layers have a thickness of 5 to 500 nm.

The electroconductive whiskers are advantageous in that since the whiskers have a relatively large length, it becomes possible to obtain a desired reduced electric resistivity of the intermediate layer by using a smaller amount of the electroconductive whiskers than that of electroconductive zinc oxide particles, etc., and thus the resultant intermediate layer has a relatively dense structure and a satisfactory water resistance. Namely, the intermediate layer of the present invention can impart not only a high resistance to toner-fogging but also a satisfactory water resistance and a high printing durability to the lithograph printing plate material.

The electroconductive whiskers are preferably present in an amount of 1 to 50% by weight, more preferably 10 to 30% by weight, based on the weight of the intermediate layer. If the amount is less than 1% by weight, the resultant intermediate layer is sometimes unsatisfactory due to a high electric resistivity thereof. If the amount of the electroconductive whisker is more than 50% by weight, the resultant intermediate layer is sometimes unsatisfactory due to a porous structure and a reduced water resistance thereof. The pigment particles usable for the intermediate layer of the present invention comprise at least one member selected from the group consisting of inorganic pigments, for example, calcium carbonate, magnesium carbonate, kaolin, talc, anhydrous clay, silica, diatomaceous earth, mica, synthetic aluminum silicate, zinc oxide, titanium dioxide, aluminum hydroxide, and barium sulfate; and organic pigments, for example, urea-formaldehyde resins, styrene-methacrylic acid copolymer resins and polystyrene resins.

The pigment particles are preferably contained in a content of 5 to 70% by weight in the intermediate layer. The binder resin usable for the intermediate layer of the present invention can be selected from water-soluble polymeric resins and water-insoluble polymeric resins. The water-soluble polymeric resins are employed in the form of an aqueous solution thereof, and the water-insoluble polymeric resins are used in the form of an aqueous emulsion thereof. The binder resin is preferably contained in a content of 30 to 90% by weight in the intermediate layer. Nevertheless, if the water-soluble polymeric resin is used in an excessive amount, the resultant intermediate layer exhibits a reduced resistance to water, and thus an unsatisfactory dimensional stability. Therefore, the water-soluble polymeric resin is preferably contained in a restricted amount of 5% by weight or less in the intermediate layer.

The water-soluble polymeric resins usable for the intermediate layer of the present invention are not specifically restricted and are preferably selected from polyvinyl alcohol, oxidized starch, modified starch, gum arabic, gelatin, casein, chitosan, methyl cellulose, hydroxyethyl cellulose, hydroxymethyl cellulose, polyvinyl pyrrolidone, polyacrylic acid salts, polyacrylamide, styrene-maleic anhydride copolymer salts, methylvinylether-maleic anhydride copolymer salts, and isopropylene-maleic anhydride copolymer salts.

The water-insoluble polymeric resins usable for the intermediate layer of the present invention are not specifically restricted, and preferably selected from styrene-butadiene copolymers, vinyl acetate-acrylic acid ester copolymers, polyurethanes, polyvinyl chloride, polyvinylidene chloride, methacrylic acid ester copolymers and acrylic acid ester copolymers, which are supplied and employed in the form of an aqueous emulsion.

In the intermediate layer of the present invention, the binder resin polymer preferably has cross-linkable reactive groups. Namely, the binder resin polymer may contain a small amount of copolymerized cross-linking monomer which may be selected from, for example, α,β-unsaturated carboxylic acid hydroxy esters, α,β-unsaturated carboxylic acid amides, glycidyl (meth)acrylates, N-methylol acrylamides, monomers having at least two double bonds, for example, diallylphthalate and allylglycidylether, and 3-chloro-2-hydroxypropyl methacrylate.

The intermediate layer of the present invention optionally contains an additive, for example, an additional dispersing agent, and a water resistance-enhancing agent which is used to further enhance the water resistance of the intermediate layer.

The water resistance-enhancing agent preferably comprises at least one member selected from multivalent aldehyde compounds, for example, glyoxal, glutaraldehyde, and dialdehydestarch, polyamine compounds, for example, polyethyleneimine, epoxy compounds, polyamide resins, glycidyl compounds, for example, glyceroldiglycidylether, dimethylurea compounds, and water resistance-enhancing inorganic compounds, for example, ammonium persulfate, ferric chloride, magnesium chloride, boric acid and borax.

The water-resistance-enhancing agent is preferably contained in a content of 10% by weight or less in the intermediate layer.

The additional dispersing agent, which is used in addition to the specific dispersing agent consisting essentially of at least one member selected from polyisoprenesulfonic acid and carboxylic acid-modified polyisoprenesulfonic acids, is preferably selected from anionic dispersing agents, for example, sodium dodecylbenzenesulfonate, sodium laurylsulfate, sodium dioctylsulfosuccinate, sodium oleate, sodium alginate, polyacrylic acid salts, vinyl compound-maleic acid copolymers, polycarboxylic acids, polysulfonic acid salts, polyphosphonic acid salts, and polyisoprenesulfonic acid salts; cationic dispersing agents, for example, cationic starch, and polyethyleneimine; and nonionic dispersing agents, for example, polyethyleneoxide-alkylphenylether, polyethyleneoxide-alkylamine, polyethyleneoxide-sorbitan fatty acid esters, polyvinyl alcohol and starch. Of course, the additional dispersing agent is not limited to the above-mentioned compounds.

In the present invention, the intermediate layer can be formed by preparing an aqueous coating liquid containing the above-mentioned components, coating the front surface of the substrate with the aqueous coating liquid, and solidifying the coated liquid layer by drying to form a solid filmy layer. In the solidifying step, the coated liquid layer is dried preferably at a temperature of 80° C. to 150° C. which effectively enhances the water resistance of the resultant intermediate layer.

After the drying, the resultant intermediate layer preferably has a basis weight of 3 to 30 g/m$^2$, more preferably 5 to 20 g/m$^2$. If the basis weight is less than 3 g/m$^2$, the resultant intermediate layer sometimes exhibits an unsatisfactory water resistance. Also, if the basis weight is more than 30 g/m$^2$, the resultant intermediate layer sometimes causes the substrate to be curled.

The intermediate layer coating liquid can be applied by any conventional coating method, for example, Mayer bar method, air knife method, blade method, reverse roll method or slit die method. Of course, the coating method is not limited to the above-mentioned methods.

In the electrophotographic lithograph printing plate material of the present invention, a photoconductive layer is formed on the intermediate layer. The photoconductive layer comprises a photoconductive pigment, for example, zinc oxide or titanium dioxide, a binder resin and optionally a sensitizing agent. Those components are dispersed or dissolved in a solvent to provide a coating liquid, the surface of the intermediate layer is coated with the coating liquid, and the coated liquid layer is dried to form the photoconductive layer.

After drying, the resultant photoconductive layer preferably has a basis weight of 20 to 30 g/m$^2$, and contains the photoconductive pigment in a content of 60 to 90% by weight. If the basis weight is less than 20 g/m$^2$, the resultant images on the photoconductive layer are unsatisfactory in image density thereof. Since the static charge potential of the photoconductive layer is saturated in a basis weight or 30 g/m$^2$ or less, an increase in the basis weight to more than 30 g/m$^2$ is meaningless. The photoconductive layer coating liquid can be applied by the same coating method as used for the intermediate layer.

The binder resin for the photoconductive layer preferably comprises at least one hydrophilic resin selected from, for example, acrylic acid ester copolymers, methacrylic acid ester copolymers, vinyl acetate copolymers, silicone resins, and polyvinyl butyral resins. For the purpose of improving the image quality, the above-mentioned polymers may be copolymerized with a functional monomer, for example, acrylic acid, methacrylic acid or maleic acid.

In the photoconductive layer, the binder resin is contained preferably in an amount of 10 to 30% by weight, more preferably 15 to 20% by weight, based on the weight of the photoconductive pigment.

The sensitizing agent usable for the photoconductive layer may be selected from conventional sensitizing agents, for example, Rose Bengale, uranine, Bromophenol Blue, and nigrosine, which have a maximum sensitivity at a wavelength of from 700 to 1000 nm and thus are capable of sensitizing the photoconductive layer with respect to semiconductor laser rays and are usable for photosensitive paints and electron acceptors.

The photoconductive layer optionally contained another additive, for example, a sensitizing assistant. The sensitizing assistant may comprise maleic anhydride, phthalic anhydride, a cobalt salt and/or a manganese salt.

In the electrophotographic lithograph printing plate material of the present invention, the back surface of the substrate is optionally coated with a back coating layer for the purpose of preventing a penetration of toner into the printing plate material during a printing plate-making step. The back coating layer comprises a binder resin and a pigment.

The back coating layer optionally contains an additive, for example, a dispersing agent, electroconductive agent and/or water resistance-enhancing agent for enhancing the water resistance of the back coating layer.

The binder resin, the pigment, the dispersing agent and water resistance-enhancing agent for the back coating layer may be respectively selected from those usable for the intermediate layer.

The electroconductive agent usable for the back coating layer includes cationic electroconductive resins, for example, polyvinylbenzyltrimethyl ammonium chloride, polydimethyldiallyl ammonium chloride, and styrene-acrylic acid-trimethylaminoethyl chloride copolymers; anionic electroconductive resins, for example, polystyrene-sulfonic acid salts, polyacrylic acid salts and polyvinylsulfonic acid salts; carbon black and electroconductive whiskers.

The back coating layer preferably has a basis weight of 5 to 30 g/m$^2$, more preferably 10 to 20 g/m$^2$. If the basis weight is less than 5 g/m$^2$, the resultant back coating layer sometimes cannot satisfactorily prevent the penetration of the toner. Also, if the basis weight is more than 30 g/m$^2$, the resultant back coating layer sometimes causes the resultant lithograph printing plate material to be curled.

The back coating layer can be formed by the same coating method as that used for the intermediate layer.

The above-mentioned electrophotographic lithograph printing plate material has a high resistance to toner-fogging, and an excellent dimensional stability and thus is useful for producing a printing plate having a high printing durability.

EXAMPLES

The present invention will be further explained by the following specific examples which are merely representative and do not restrict the scope of the present invention in any way.

In the examples, the term "part" refers to—part by dry weight—.

Example 1

(1) An aqueous dispersion of electroconductive whiskers was prepared by the following procedures.

A dispersing agent comprising an aqueous solution of 40% by weight of an isoprenesulfonic acid-acrylic acid copolymer and available under a trademark of DINAFLOW P103, from Nihon Synthetic Rubber Co, was dissolved in an amount of 2.5 parts in 400 parts of water. To the dispersing agent solution, 100 parts of electroconductive ceramic whiskers composed of needle-shaped potassium titanate cores coated with antimony-doped tin oxide layers and available under the trademark of DENTOL WK-200B from Otsuka Kagaku K.K. were added while stirring by using a Kaures mixer. The whiskers were easily wetted with the aqueous dispersing agent solution and uniformly dispersed therein to provide an aqueous dispersion having a satisfactory fluidity. After the addition of the electroconductive whiskers was completed, the dispersion was further stirred by the Kaures mixer for 20 minutes. When the dispersion contained in a container was left to stand at room temperature for 24 hours, it was found that the electroconductive whisker dispersion was slightly and partly concentrated in the bottom of the container. However, the dispersion could be easily homogenized by stirring it by the Kaures mixer.

(2) An aqueous coating liquid for an intermediate layer was prepared in the following composition.

| Component | Amount (part) |
|---|---|
| Electroconductive whiskers (DENTOL WK-200B) | 10 |
| Kaolinite clay $(*)_1$ | 20 |
| Polyacrylic resin emulsion $(*)_2$ | 35 |
| Polyurethane resin emulsion $(*)_3$ | 35 |

Note:
$(*)_1$ . . . Trademark: HYDROGROSS 90
Manufacturer: Huber
$(*)_2$ . . . Trademark: A-104
Manufacturer: Toa Gosei K.K.
Solid content: 40% by weight
$(*)_3$ . . . Trademark: BIROCK RL-3
Manufacturer: Kanebo NSC
Solid content: 40% by weight In the preparation of the coating liquid, the above-mentioned aqueous dispersion of the electroconductive whiskers (DENTOL WK-200B) was employed.

(3) A paper sheet having a basis weight of 100 g/m$^2$ was coated on the front surface thereof with 2 g/m$^2$ of a barrier layer composed of 80 parts of polyvinyl alcohol and 20 parts of sodium polyacrylate by a size-press method.

(4) The barrier layer surface of the paper sheet was coated with the coating liquid and dried at a temperature of 100° C. for 1 minute to provide an intermediate layer having a dry basis weight of 15 g/m$^2$.

(5) The surface of the intermediate layer was coated with a coating liquid having the following composition to form 25 g/m$^2$ of a photoconductive layer.

| Component | Amount (part) |
|---|---|
| Photoconductive zinc oxide $(*)_4$ | 100 |
| Silicone resin $(*)_5$ | 30 |
| Rose Bengale | 0.1 |

Note:
$(*)_4$ . . . Trademark: SAZEX 2000
Manufacturer: Sakai Kagaku K.K.
$(*)_5$ . . . Trademark: SILICONEKR-211
Manufacturer: Sinetsu Kagaku K.K.

(6) A back coating layer in a dry amount of 10 g/m$^2$ was formed on the back surface of the paper sheet by coating a coating liquid having the following composition.

| Component | Amount (part) |
|---|---|
| Polyvinyl alcohol $(*)_6$ | 30 |
| Polyvinyl acetate resin $(*)_7$ | 50 |
| Polystyrenesulfonic acid salt $(*)_8$ (Electroconductive agent) | 20 |

Note:
$(*)_6$ . . . Trademark: GOSENOL T-330
Manufacturer: Nihon Gosei Kagaku K.K.
$(*)_7$ . . . Trademark: SEBIAN A-522
Manufacturer: Daicel -continued

| Component | Amount (part) |
|---|---|

$(*)_8$ . . . Trademark: CHEMISTATT 6120
Manufacturer: Sanyo Kasei K.K.

(7) Test (i) The coating liquid for the intermediate layer was left to stand for 3 hours from the completion of preparation thereof. The resultant coating liquid was observed by naked eye to evaluate the settling stability of the coating liquid.
Good: No settling was found
Bad: Settling was found (ii) The resultant electrophotographic lithograph printing plate material was conditioned in a dark place at a temperature of 25° C. at a relative humidity of 50% for 24 hours, and then subjected to a printing plate-making procedure by using an electrophotographic printing plate-making machine (Trademark: Itek 275, Manufacturer: Itek Graphix Corporation). The resistance of the printing plate material to toner-fogging was evaluated by naked eye observation. The test result is indicated in Table 1.

The printing plate was treated with an etching liquid to make the printing plate surface insensitive to ink and then subjected to a printing procedure by using an offset printing machine (Trademark: 2800CD, Manufacturer: Ryobi). A printing plate elongation of the printing plate was determined in accordance with the following equation:

$$\text{Printing plate elongation (\%)} = \frac{L_{3000} - L_1}{L_1} \times 100$$

wherein $L_1$ represents a length of an image on a first print and $L_{3000}$ represents a length of the image on a 3000th print, measured in a moving direction of the print.

When the printing plate elongation is 0.30% or less, the printing plate appears satisfactory in dimensional stability thereof.

The test results are shown in Table 1.

Example 2

An electrophotographic lithograph printing plate material was produced and tested by the same procedures as in Example 1 with the following exceptions.

(1) An aqueous dispersion of electroconductive whiskers was prepared by the following procedures.

A dispersing agent comprising an aqueous solution of 40% by weight of a polyisoprenesulfonic acid and available under a trademark of DINAFLOW Z105, from Nihon Synthetic Rubber Co, was dissolved in an amount of 2.0 parts in 400 parts of water. To the dispersing agent solution, 100 parts of electroconductive whiskers composed of needle-shaped titanium dioxide cores coated with antimony-doped tin oxide layers and available under the trademark of FT-1000 from Ishihara Sangyo K.K. were added while stirring by using a Kaures mixer. The whiskers were easily wetted with the aqueous dispersing agent solution and uniformly dispersed therein to provide an aqueous dispersion having a satisfactory fluidity. After the addition of the electroconductive whiskers was completed, the dispersion was further stirred by the Kaures mixer for 20 minutes. When the dispersion contained in a container was left to stand at room temperature for 24 hours, it was found that the electroconductive whisker dispersion was slightly and partly concentrated in the bottom of the container. However, the dispersion could be easily homogenized by stirring it by the Kaures mixer.

(2) An aqueous coating liquid for an intermediate layer was prepared in the following composition.

| Component | Amount (part) |
|---|---|
| Electroconductive whiskers (FT-1000) | 10 |
| Kaolinite clay $(*)_1$ | 20 |
| Polyacrylic resin emulsion $(*)_2$ | 35 |
| Polyurethane resin emulsion $(*)_3$ | 35 |

In the preparation of the coating liquid, the above-mentioned aqueous dispersion of the electroconductive whiskers (FT-1000) was employed.

The test results are shown in Table 1.

Example 3

An electrophotographic lithograph printing plate material was produced and tested by the same procedures as in Example 2 with the following exception.

The electroconductive whiskers of Example 2 were replaced by electroconductive whiskers composed of needle-shaped titanium dioxide cores coated with antimony-doped tin oxide coatings and available under the trademark of FT-2000 from Ishihara Sangyo K.K.

Example 4

An electrophotographic lithograph printing plate material was produced and tested by the same procedures as in Example 1 with the following exceptions.

(1) The electroconductive whiskers of Example 1 were replaced by electroconductive whiskers composed of needle-shaped potassium titanate cores coated with carbon and available under the trademark of DENTOL WK-300 from Otsuka Kagaku K.K.

(2) The coating liquid for the intermediate layer had the following composition.

| Component | Amount (part) |
|---|---|
| Electroconductive whiskers (DENTOL WK-300) | 10 |
| Kaolinite clay $(*)_1$ | 20 |
| Polyacrylic resin emulsion $(*)_2$ | 30 |
| Polyurethane resin emulsion $(*)_3$ | 35 |

Example 5

An electrophotographic lithograph printing plate material was produced and tested by the same procedures as in Example 1 with the following exception.

The electroconductive whiskers of Example 1 were replaced by another electroconductive whiskers composed of needle-shaped aluminum borate cores coated with an antimony-doped tin oxide coating, and available under the trademark of PASTRAN TYPE-V, from Mitsui Metal Kogyo K.K.

Comparative Example 1

An electrophotographic lithograph printing material was produced and tested by the same procedures as in Example 1 with the following exceptions.

In the preparation of the aqueous electroconductive whiskers (DENTOL WK 200B) dispersion, the isoprenesulfonic acid-acrylic acid copolymer dispersing agent (DINAFLOW P103) was replaced by a polyacrylic acid dispersing agent (trademark: Calibon L 400, manufacturer: Sanyo Kasei K.K., solid content: 40% by weight). In the formation of the photoconductive layer, the above-mentioned whisker dispersion was employed.

The test results are shown in Table 1.

Comparative Example 2

An electrophotographic lithograph printing plate material was produced and tested by the same procedures as in Example 2 with the following exceptions.

In the preparation of the aqueous electroconductive whiskers (FT-1000) dispersion, the polyisoprenesulfonic acid dispersing agent (DINAFLOW Z105) was replaced by a polyacrylic acid dispersing agent (trademark: Calibon L 400, manufacturer: Sanyo Kasei K.K., solid content: 40% by weight). In the preparation of the photoconductive .Layer, the above-mentioned whisker dispersion was employed.

The test results are shown in Table 1.

Comparative Example 3

An electrophotographic lithograph printing plate material was produced and tested by the same procedures as in Example 1 with the following exceptions.

(1) No electroconductive whiskers were employed.

(2) The intermediate layer was formed from an aqueous coating liquid having the following composition.

| Component | Amount (part) |
|---|---|
| Kaolinite clay $(*)_1$ | 30 |
| Polyacrylic resin emulsion $(*)_2$ | 35 |
| Polyurethane resin emulsion $(*)_3$ | 35 |

The test results are shown in Table 1.

Comparative Example 4

An electrophotographic lithograph printing plate material was produced and tested by the same procedures as in Example 1 with the following exceptions.

(1) No electroconductive whiskers were employed.

(2) The photoconductive layer was formed from an aqueous coating liquid having the following composition.

| Component | Amount (part) |
|---|---|
| Kaolinite clay $(*)_1$ | 27 |
| Polyacrylic resin emulsion $(*)_2$ | 35 |
| Polyurethane resin emulsion $(*)_3$ | 35 |
| Polystyrenesulfonic acid salt $(*)_8$ (Electroconductive gent, CHEMISTATT 6120) | 3 |

The test results are shown in Table 1.

Comparative Example 5

An electrophotographic lithograph printing plate material was produced and tested by the same procedures as in Example 1, with the following exceptions.

(1) No electroconductive whiskers were employed.

(2) The photoconductive layer was formed from the aqueous coating liquid having the following composition.

| Component | Amount (part) |
|---|---|
| Aqueous carbon black dispersion $(*)_9$ | 10 |
| Kaolinite clay $(*)_1$ | 20 |
| Polyacrylic resin emulsion $(*)_3$ | 35 |
| Polyurethane resin emulsion $(*)_4$ | 35 |

Note:
$(*)_9$ . . . Trademark: LKB-100
Manufacturer: Haechst Gosei K.K.

The test results are shown in Table 1.

TABLE 1

| Example No. | Item: Stability of intermediate layer coating liquid to settling out | Resistance to toner fogging | Elongation of printing plate (Dimensional stability) (%) |
|---|---|---|---|
| Example | | | |
| 1 | Good | Good | 0.11 |
| 2 | Good | Good | 0.11 |
| 3 | Good | Good | 0.11 |
| 4 | Good | Good | 0.09 |
| 5 | Good | Good | 0.10 |
| Comparative Example | | | |
| 1 | Bad | Bad | — |
| 2 | Bad | Bad | 0.22 |
| 3 | — | Bad | 0.11 |
| 4 | — | — | 0.50 |
| 5 | — | — | 0.74 |

We claim:

1. An electrophotographic lithograph printing plate precursor comprising:

a substrate;

an intermediate layer formed on a front surface of the substrate, said intermediate layer comprising a mixture of a binder comprising a polymeric material, a dispersing agent, pigment particles and electroconductive whiskers uniformly dispersed in the binder, said dispersing agent comprising at least one member selected from the group consisting of polyisoprenesulfonic acid and carboxylic acid-modified polyisoprenesulfonic acids; and a photoconductive layer formed on a surface of the intermediate layer and comprising a mixture of an electrically insulating binder and photoconductive pigment uniformly dispersed in the binder.

2. The lithograph printing plate precursor as claimed in claim 1, wherein the dispersing agent is present in an amount of 0.05 to 3% by weight, based on the weight of the electroconductive whiskers.

3. The lithograph printing plate precursor as claimed in claim 1, wherein the intermediate layer is one prepared by dispersing the pigment particles and the electroconductive whiskers in an aqueous medium containing the binder and the dispersing agent to provide an aqueous coating liquid; coating the front surface of the substrate with the aqueous coating liquid; and drying the coated aqueous coating liquid on the substrate front surface.

4. The lithograph printing plate precursor as claimed in claim 1, wherein the electroconductive whiskers are present in an amount of 1 to 50% by weight, based on the weight of the intermediate layer.

5. The lithograph printing plate precursor as claimed in claim 1, wherein the electroconductive whiskers comprise fiber-shaped whisker cores consisting essentially of a member selected from the group consisting of potassium titanate, aluminum borate, zinc oxide, titanium dioxide, aluminum nitride, boron nitride, titanium nitride, alumina, magnesium hydrogen sulfate, and barium sulfate, wherein coating layers are formed on the surfaces of the fiber-shaped whisker cores, said coating layers consisting essentially of an electroconductive material.

6. The lithograph printing plate precursor as claimed in claim 5, wherein the electroconductive material for the coating layers comprises at least one member selected from the group consisting of electroconductive metal oxides and carbon.

7. The lithograph printing plate precursor as claimed in claim 1, wherein the whisker cores have a length of 10 to 30 μm and a diameter of 0.2 to 1.2 μm, and the electroconductive coating layers have a thickness of 5 to 500 μm.

8. The lithograph printing plate precursor as claimed in claim 1, wherein the pigment particles for the intermediate layer comprise at least one member selected from the group consisting of calcium carbonate, magnesium carbonate, kaolin, talc, anhydrous clay, silica, diatomaceous earth, mica, synthetic aluminum silicate, zinc oxide, titanium dioxide, aluminum hydroxide, barium sulfate, urea-formaldehyde resins, styrene-methacrylic acid copolymer resins and polystyrene resins.

9. The lithograph printing plate precursor as claimed in claim 1, wherein the pigment particles for the intermediate layer are present in an amount of 5 to 70% by weight, based on the weight of the intermediate layer.

10. The lithograph printing plate precursor as claimed in claim 1, wherein the binder in the intermediate layer is derived from at least one member selected from the group consisting of an aqueous solution of at least one water-soluble polymeric resin and an aqueous emulsion of at least one water-insoluble polymeric resin.

11. The lithograph printing plate precursor as claimed in claim 1, wherein the intermediate layer binder is present in an amount of 30 to 90% by weight, based on the weight of the intermediate layer.

12. The lithograph printing plate precursor as claimed in claim 1, wherein the intermediate layer is present in a basis weight of 3 to 30 g/m$^2$.

13. The lithograph printing plate precursor as claimed in claim 1, wherein the substrate is further coated on a back surface thereof with a back coating layer comprising a mixture of a binder and a pigment.

14. The lithograph printing plate precursor as claimed in claim 13, wherein the back coating layer further comprises an electroconductive material.

15. The lithograph printing plate precursor as claimed in claim 14, wherein the electroconductive material for the back coating layer comprises at least one member selected from the group consisting of electroconductive polymeric resins, carbon black and electroconductive whiskers.

16. The lithograph printing plate precursor as claimed in claim 13, wherein the back coating layer is present in a basis weight of 5 to 30 g/m$^2$.

* * * * *